US009750659B2

(12) United States Patent
Wang

(10) Patent No.: US 9,750,659 B2
(45) Date of Patent: Sep. 5, 2017

(54) TILTING INVERSION EXERCISER HAVING SAFETY FOOT RETAINING DEVICE

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Beitun Taichung (TW)

( * ) Notice: Subject to any disclaimer, the term of this patent is extended or adjusted under 35 U.S.C. 154(b) by 178 days.

(21) Appl. No.: 14/929,613

(22) Filed: Nov. 2, 2015

(65) Prior Publication Data

US 2017/0119612 A1 May 4, 2017

(51) Int. Cl.

| | |
|---|---|
| ***A63B 26/00*** | (2006.01) |
| ***A61H 1/00*** | (2006.01) |
| ***A63B 21/00*** | (2006.01) |
| ***A61G 15/00*** | (2006.01) |

(52) U.S. Cl.

CPC ..... *A61H 1/001* (2013.01); *A61G 15/007* (2013.01); *A63B 21/4029* (2015.10); *A63B 21/4047* (2015.10)

(58) Field of Classification Search

CPC ..... A63B 2208/0285; A63B 2208/029; A63B 21/4029; A63B 21/4047; A61G 15/007; A61H 1/0222; A61H 1/0229; A61H 2203/0493; A61H 2201/1642

USPC ..... 482/143–145

See application file for complete search history.

(56) References Cited

U.S. PATENT DOCUMENTS

| | | | | |
|---|---|---|---|---|
| 4,232,662 | A * | 11/1980 | Barber | A61H 1/0218 482/144 |
| 5,551,937 | A * | 9/1996 | Kwo | A61H 1/0229 482/144 |
| 5,718,660 | A | 2/1998 | Chen | |
| 7,077,795 | B2 | 7/2006 | Chen | |
| 7,081,073 | B1 | 7/2006 | Smith | |
| 7,118,518 | B1 | 10/2006 | Teeter | |
| 7,585,264 | B1 * | 9/2009 | Wang | A61H 1/0218 482/144 |
| 2009/0249589 | A1 * | 10/2009 | Wu | A61H 1/0218 24/457 |
| 2013/0079204 | A1 * | 3/2013 | Wang | A61H 1/0222 482/144 |
| 2014/0274625 | A1 * | 9/2014 | Chen | A61H 1/0229 482/144 |
| 2016/0361586 | A1 * | 12/2016 | Wang | A61H 1/0229 |

* cited by examiner

*Primary Examiner* — Gregory Winter
(74) *Attorney, Agent, or Firm* — Charles E. Baxley

(57) ABSTRACT

A tilting inversion exerciser includes a foot support attached to an extension of a table, a carrier attached to the extension, a spindle attached to the extension, and a foot retaining device includes a lever having an oblong hole for slidably engaging with the spindle, a stem slidably attached to the lever, a pin attached to the stem and slidably engaged in a curved channel of the carrier biased to engage with the carrier, and the lever is engageable with the pin for retaining the pin to the carrier and for preventing the pin from being disengaged from the carrier when the extension of the table is inverted to an up-side-down position, and for giving some security to the user while conducting the inversion exercises.

2 Claims, 15 Drawing Sheets

TILTING INVERSION EXERCISER HAVING SAFETY FOOT RETAINING DEVICE

BACKGROUND OF THE INVENTION

1. Field of the Invention

The present invention relates to a tilting inversion exerciser, and more particularly to a tilting inversion exerciser having a rotating ankle holder or foot retaining device for detachably securing the ankle portions or the feet of the user to the foot retaining device of the tilting inversion exerciser, and for giving some security to the user while conducting the inversion exercises, and for preventing the feet of the user from being disengaged from the foot retaining device inadvertently.

2. Description of the Prior Art

Typical tilting inversion exercisers comprise a base or table pivotally or rotatably supported on a lower support stand for supporting a user thereon, and for allowing the user to tilt or to incline the table relative to the lower support, in order to conduct the typical tilting inversion exercises, and comprise an ankle holder or foot retaining device attached to the table for detachably securing the ankle portions of the user to the table of the tilting inversion exerciser and for preventing the feet of the user from being disengaged from the foot retaining device inadvertently, particularly when the table is inverted to an up-side-down position.

For example, U.S. Pat. No. 5,718,660 to Chen, U.S. Pat. No. 7,077,795 to Chen, U.S. Pat. No. 7,081,073 to Smith, and U.S. Pat. No. 7,118,518 to Teeter disclose several of the typical tilting inversion exercisers each also comprising a base or table pivotally or rotatably supported on a lower support for supporting a user thereon, a foot rest or ankle holder or foot retaining device attached to the table for detachably securing the ankle portions of the user to the table of the tilting inversion exerciser, and a handle pivotally attached to the foot rest for being rotated relative to the foot rest to clamp and to stably lock and retain the feet of the user to the base or table.

However, the ankle holder or foot retaining devices have no locking devices or mechanism to lock the foot retaining devices in place, and the foot retaining devices of the typical tilting inversion exercisers may be conducted or actuated or operated inadvertently by children, for example, and the feet of the user may have a good chance to be disengaged from foot retaining device and the base or table particularly when the base or table is inverted, such that the user may also have a good chance to be disengaged from base or table inadvertently.

The present invention has arisen to mitigate and/or obviate the afore-described disadvantages of the conventional foot retaining devices for the tilting inversion exercisers.

SUMMARY OF THE INVENTION

The primary objective of the present invention is to provide a tilting inversion exerciser including a rotating ankle holder or foot retaining device for detachably securing and retaining the ankle portions or the feet of the user to the foot retaining device of the tilting inversion exerciser and for giving some security to the user while conducting the inversion exercises and for preventing the feet of the user from being disengaged from the foot retaining device inadvertently.

In accordance with one aspect of the invention, there is provided a tilting inversion exerciser comprising a supporting stand, a table rotatably supported on the supporting stand with a pivot axle, and including an extension extended from the table, and including a foot support attached to the extension, and including a carrier attached to the extension, the carrier including a curved channel formed therein, and the carrier including a plurality of depressions formed therein and communicating with the curved channel of the carrier, a spindle attached to the extension, and a foot retaining device including a lever including an oblong hole formed in a first end portion of the lever for slidably engaging with the spindle and for allowing the lever to be pivoted relative to the carrier and the extension, a foot anchor device attached to the lever and movable toward and away from the foot support of the extension when the lever is pivoted relative to the carrier and the extension, a stem slidably attached to the lever, the stem including a first end portion, a pin attached to the first end portion of the stem and slidably engaged in the curved channel of the carrier, a spring biasing member coupled between the stem and the lever for biasing the pin to engage with either of the depressions of the carrier, and when the extension of the table is inverted to an up-side-down position where the extension is located above the table, the lever being movable downwardly relative to the extension and the spindle and the pin with a sliding engagement between the pin and the oblong hole of the lever, and the lever being engageable with the pin for retaining the pin in either of the depressions of the carrier, and for preventing the pin from being disengaged from the depression of the carrier, and for giving some security to the user while conducting the inversion exercises.

The lever includes a groove formed therein for slidably receiving and engaging with the pin. The stem includes a slot formed therein, and the lever includes a pole attached to a second end portion of the lever and slidably engaged in the slot of the stem engaging with the pole for guiding the stem to move relative to the lever.

The stem includes a rod attached to the stem, and the spring biasing member is coupled between the rod and the pole. The lever includes a passage formed therein for slidably receiving and engaging with the rod. The foot retaining device includes an actuating member attached to the stem for forcing the stem to move relative to the lever and for moving and disengaging the pin from the depressions of the carrier.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
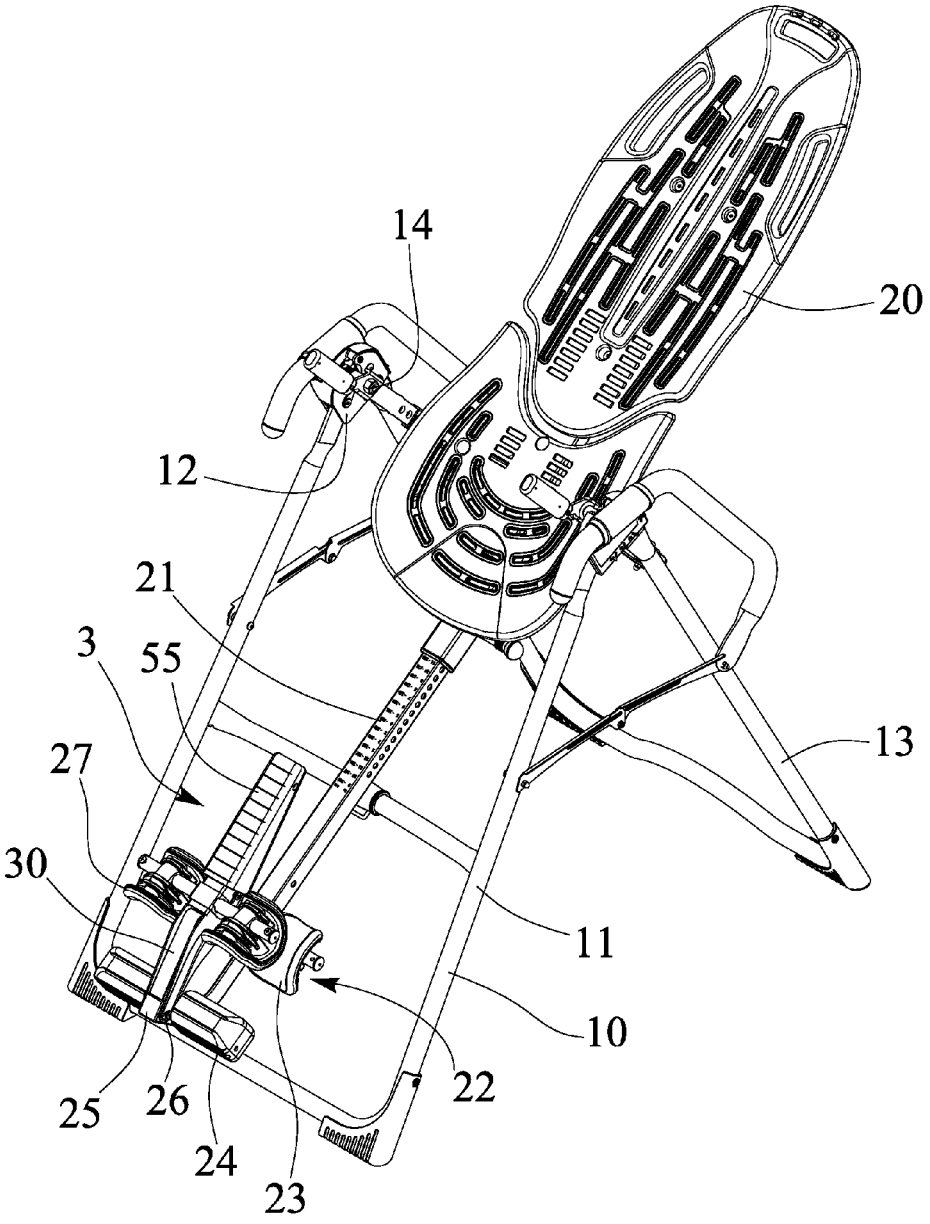
FIG. 1 is an upper perspective view of a tilting inversion exerciser in accordance with the present invention.
Figure 2:
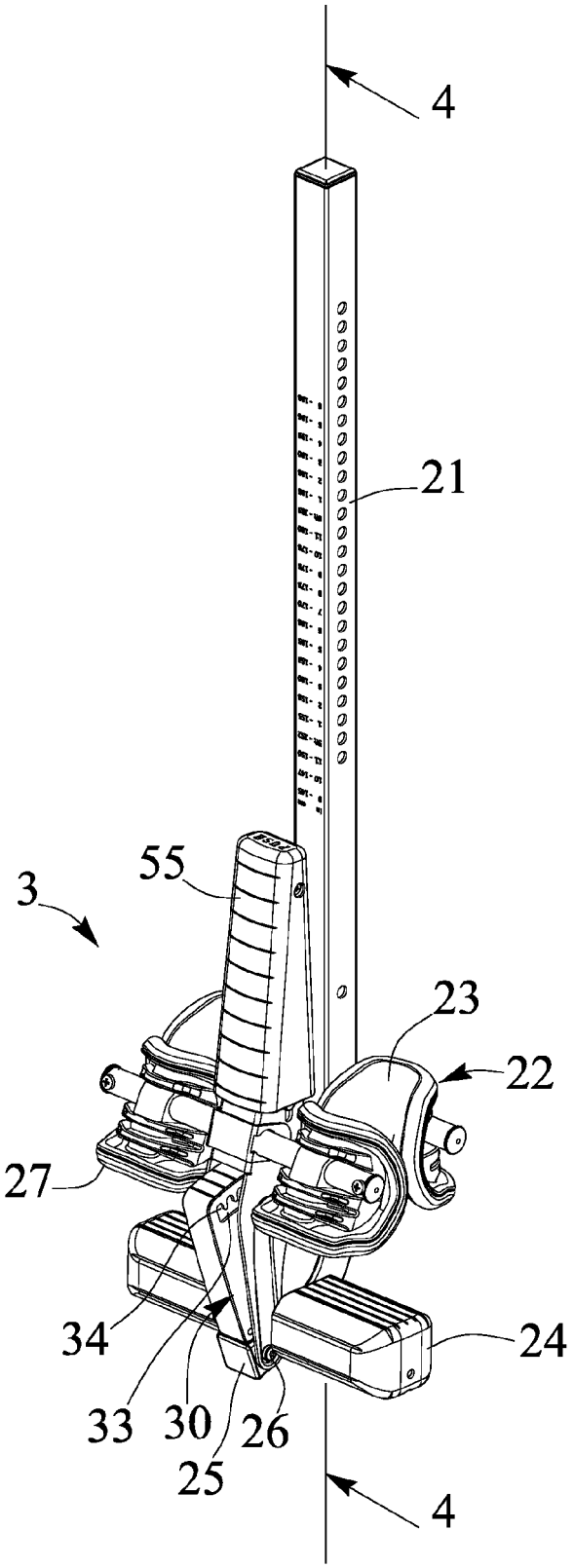
FIG. 2 is a partial perspective view illustrating the ankle holder device of the tilting inversion exerciser.
Figure 11:
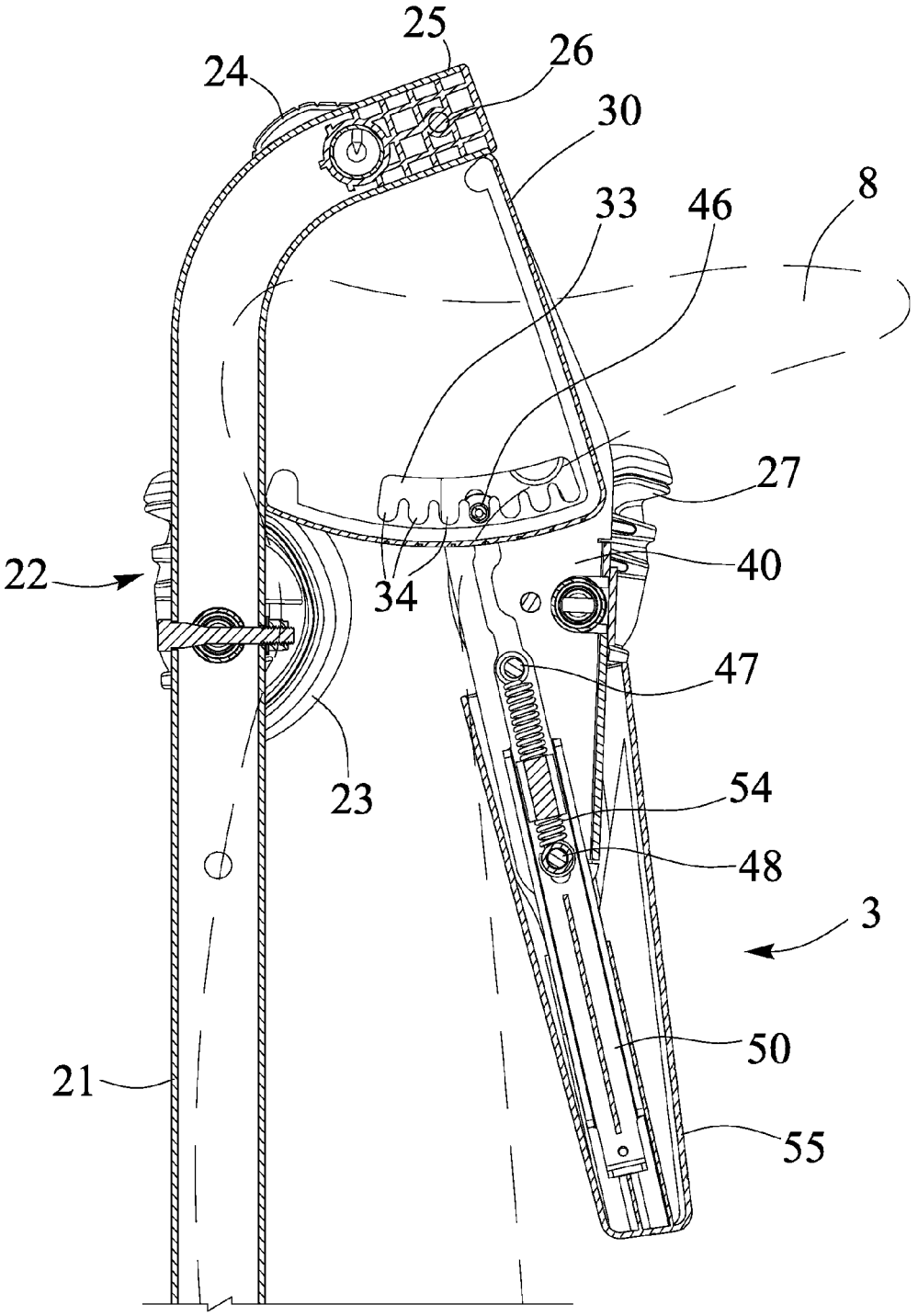
FIGS. 11, 12, 13 are partial cross sectional views similar to FIGS. 4-10, illustrating the operation of the ankle holder device of the tilting inversion exerciser when the tilting inversion exerciser and the ankle holder device are inverted at an up-side-down status or position.
Figure 12:
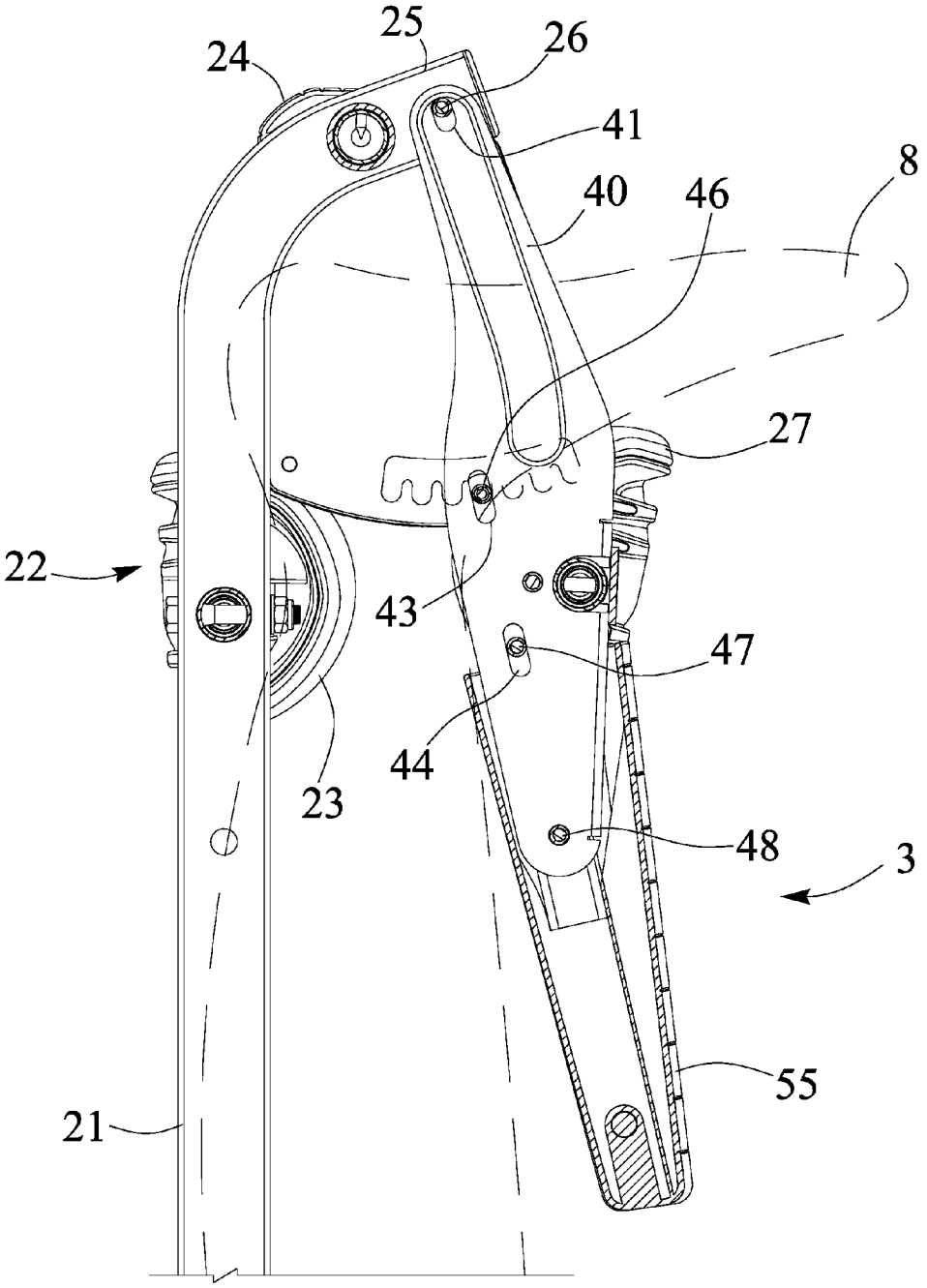
Figure 13:
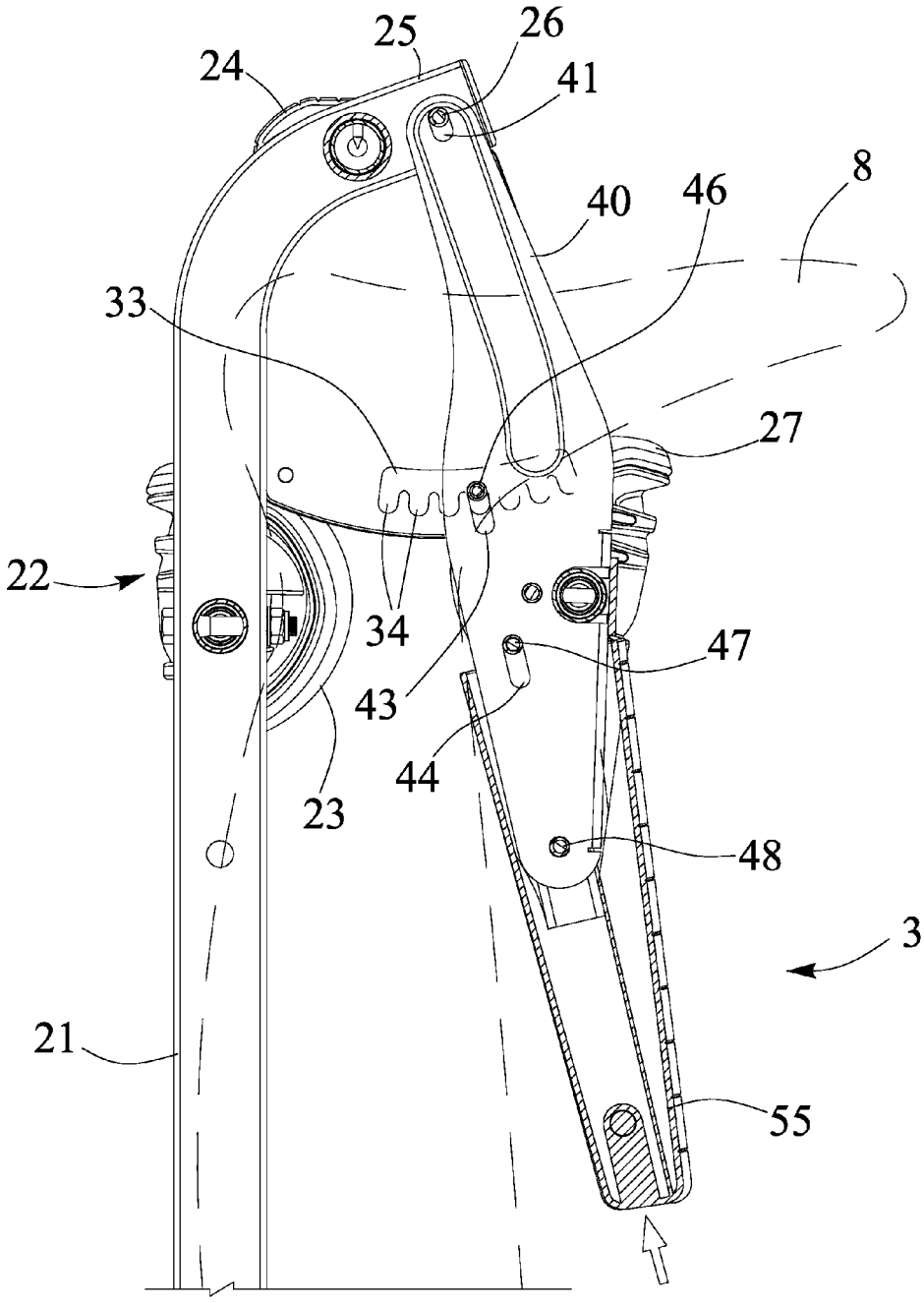

Referring to the drawings, and initially to FIG. 1, a tilting inversion exerciser in accordance with the present invention comprises a lower supporting stand 10 for pivotally or rotatably supporting a base or table 20 thereon, and for supporting a user 8 (FIGS. 8-14) on the table 20, the lower supporting stand 10 includes such as two pairs of legs 11 having upper ends pivotally coupled together with two apex plates 12, so as to form two inverted V-shaped or A-shaped frames 13. The table 20 may be pivotally or rotatably attached to and supported on the apex plates 12 of the lower supporting stand 10 with such as pivot axles 14, for allowing the table 20 to be pivoted or rotated relative to the pivot axles 14 and/or the apex plates 12 of the lower supporting stand 10 between a normal status or non-inverted position (FIG. 1) and an up-side-down inverted position (FIGS. 11-13).

The table 20 includes an extension 21, such as an adjustable or extendible or retractable extension 21 attached or coupled or extended from the other end or lower portion of the table 20 for supporting an ankle holder or foot retaining device 3 and for holding or retaining or positioning the foot of the user to the table 20 with the foot retaining device 3. The extension 21 may be extended or adjusted relative to the table 20 for moving or adjusting the foot retaining device 3 toward or away from the table 20, according to the height or dimension of the user 8, for example. The above-described structure or configuration for the extension 21 and the table 20 is typical and is not related to the present invention and will not be described in further details.

As shown in FIGS. 1-4, the table 20 includes a fixed foot support 22 attached to the extension 21, and the fixed foot support 22 includes two soft pads 23 attached to the extension 21 to comfortably support the foot of the user (FIGS. 8-13, 15), such as the ankle portion 8 of the user. A pair of foot pedals 24 may further be provided and attached or mounted or secured to the bottom or free end portion 25 of the extension 21, for example, for further stably engaging with and supporting the foot of the user, or for being stepped by the foot of the user. For example, as shown in FIG. 1, when the tilting inversion exerciser is retained or positioned or rotated to the normal status or non-inverted position, the feet of the user may step onto the foot pedals 24 and may have his ankle portions 8 engaged with and supported on the pads 23 of the fixed foot support 22.

Figure 3:
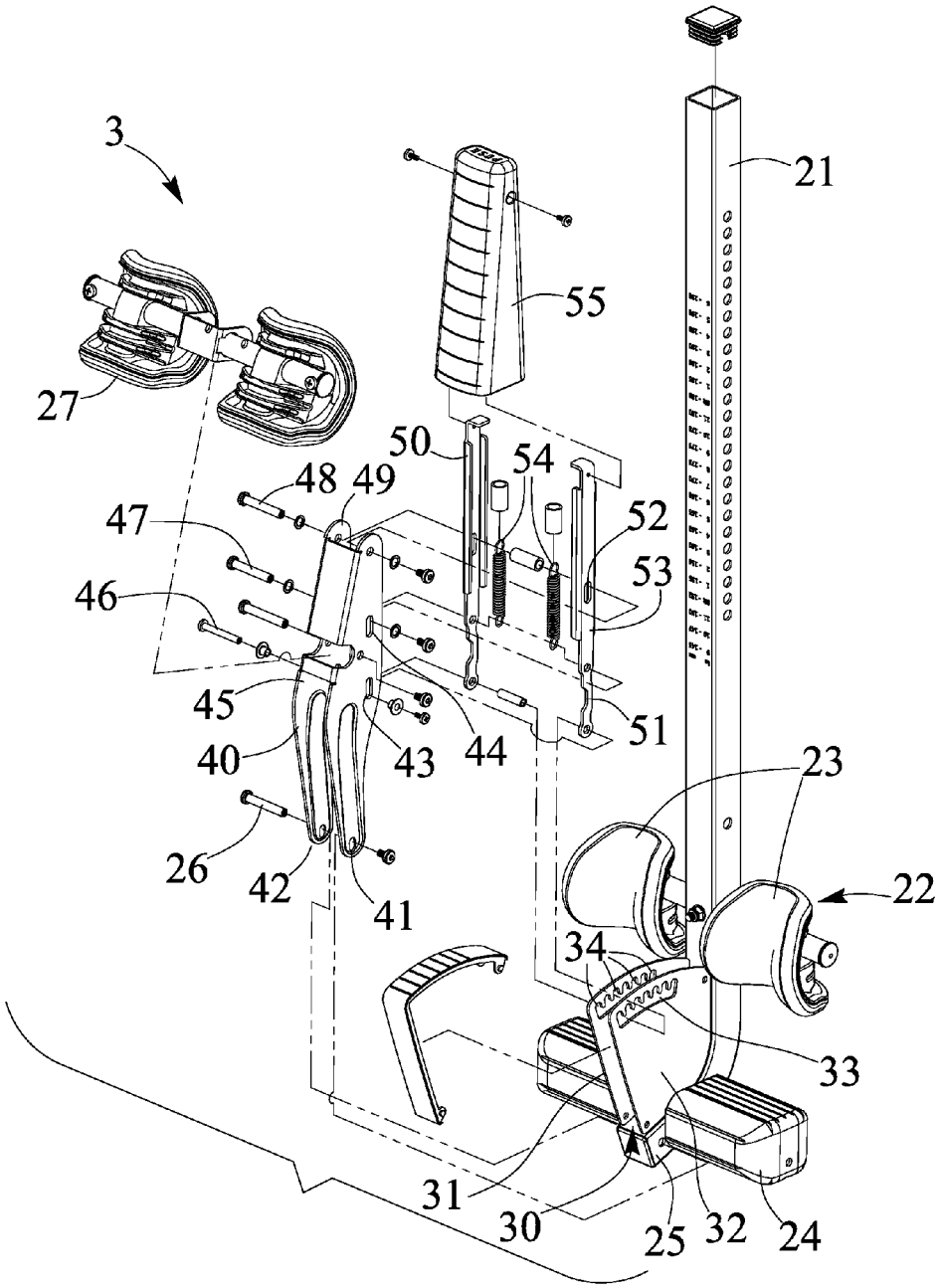
FIG. 3 is a partial exploded view illustrating the ankle holder device of the tilting inversion exerciser.

The foot retaining device 3 includes a housing or carrier 30 attached or mounted or secured to the extension 21, such as the free end portion 25 of the extension 21 of the table 20 with latches or locks or fasteners (not illustrated), and includes two housing members or carrier panels 31, 32 disposed close to each other but spaced from each other (FIG. 3). As shown in FIGS. 1, 4-13 and 15, the carrier 30 includes a curved channel 33 formed therein, and includes one or more cavities or depressions 34 formed therein and communicating with the curved channel 33 of the carrier 30. A pivot spindle 26 is also attached or mounted or secured to the free end portion 25 of the extension 21 of the table 20 and disposed or located in the center portion of the curved channel 33 of the carrier 30; i.e., the curvature center of the curved channel 33 of the carrier 30 is located at the spindle 26.

A bar or lever 40 includes an oblong hole 41 formed in one or first or lower or bottom end portion 42 thereof for slidably receiving or engaging with the pivot spindle 26 and for allowing the lever 40 to be pivoted or rotated relative to the carrier 30 and the extension 21 of the table 20. It is to be noted that the oblong hole 41 of the lever 40 includes a length greater than the diameter of the pivot spindle 26 for allowing the lever 40 to be slightly moved relative to the carrier 30 and the extension 21 of the table 20. The lever 40 further includes a groove 43 and a passage 44 formed in the middle or intermediate portion 45 of the pivot spindle 26 for slidably receiving or engaging with the pin 46 and the rod 47 respectively, and a pole 48 is attached or mounted or secured to the other or second or upper end portion 49 of the lever 40 and moved in concert with the lever 40.

The lever 40 includes two foot anchor members or a foot anchor device 27 attached to the middle or intermediate portion 45 of the lever 40 and movable toward and away from the fixed foot support 22 of the extension 21 (FIGS. 4-13) by pivoting or rotating the lever 40 relative to the carrier 30 and the extension 21 of the table 20 and for allowing the foot of the user to be solidly and stably anchored or retained to the extension 21 of the table 20 and for preventing the foot of the user from being disengaged from the table 20 and the extension 21. The foot retaining device 3 further includes one or more (such as two) arms or bars or stems 50 each having a bottom or lower or first end portion 51 attached or mounted or secured to the pin 46 and the rod 47 which are slidably received or engaged in the groove 43 and the passage 44 of the lever 40 respectively for guiding the stem 50 to move up and down relative to the lever 40.

Figure 4:
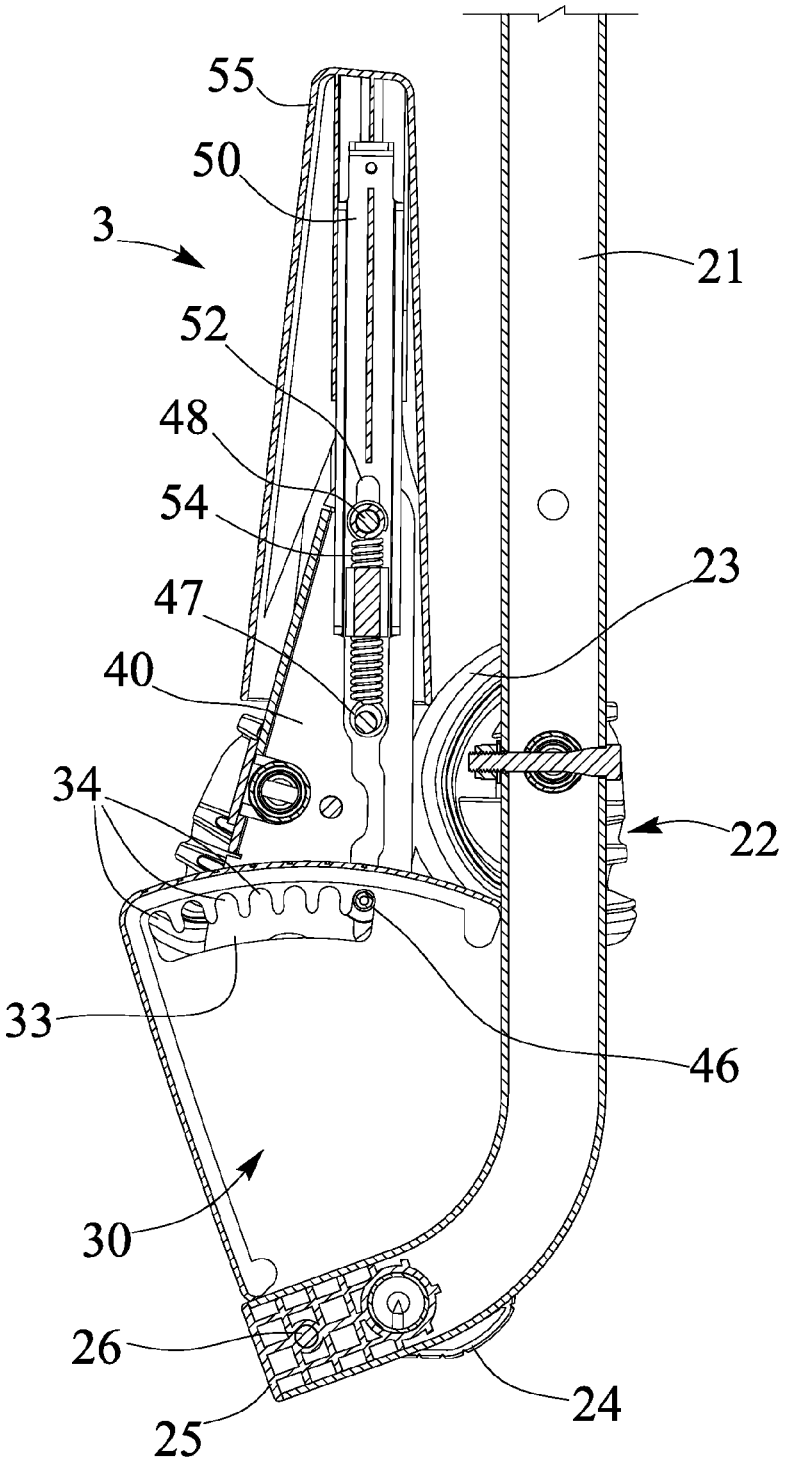
FIG. 4 is a partial cross sectional view of the ankle holder device of the tilting inversion exerciser, taken along lines 4-4 of FIG. 2.
Figure 7:
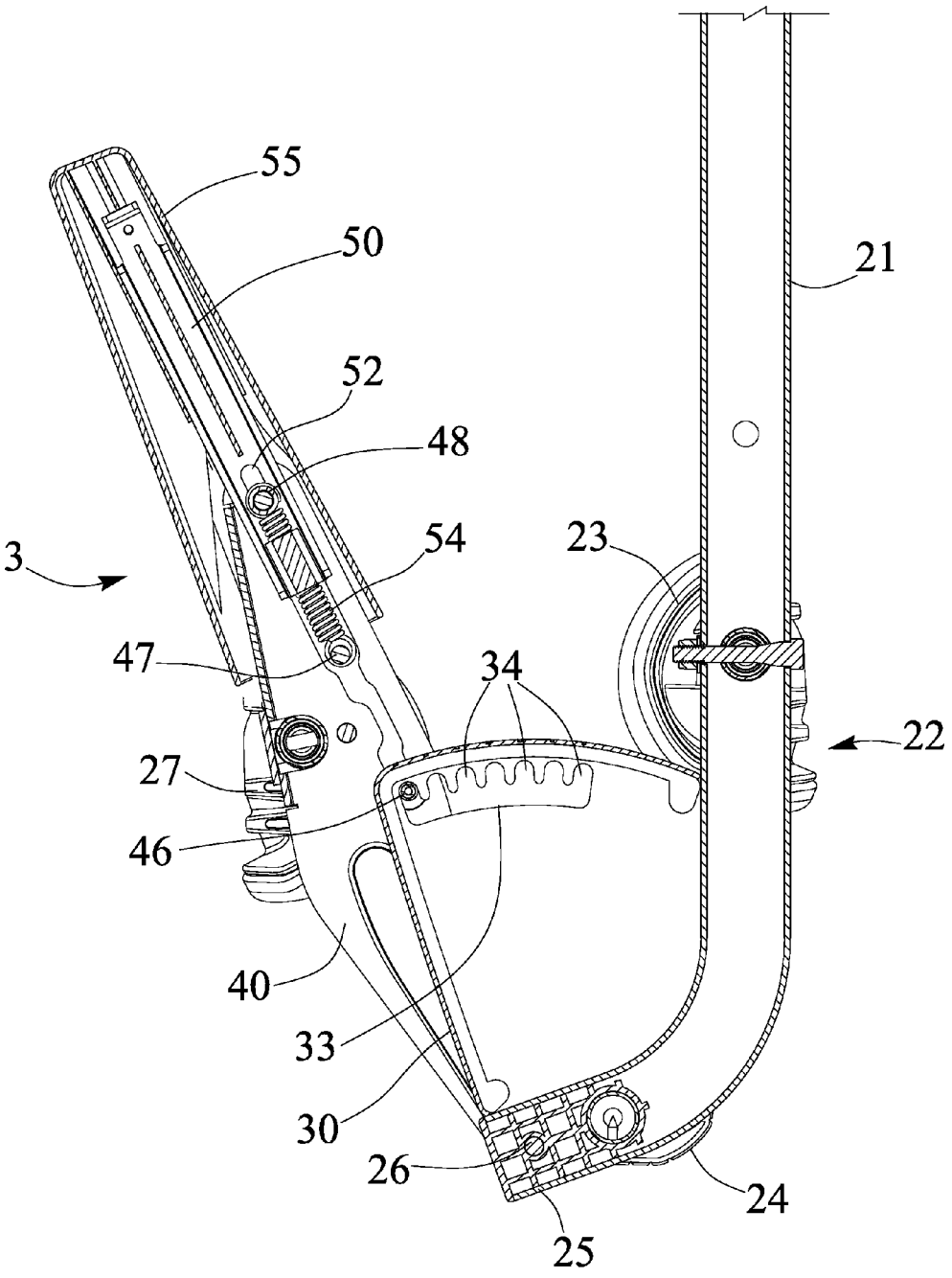
Figure 10:
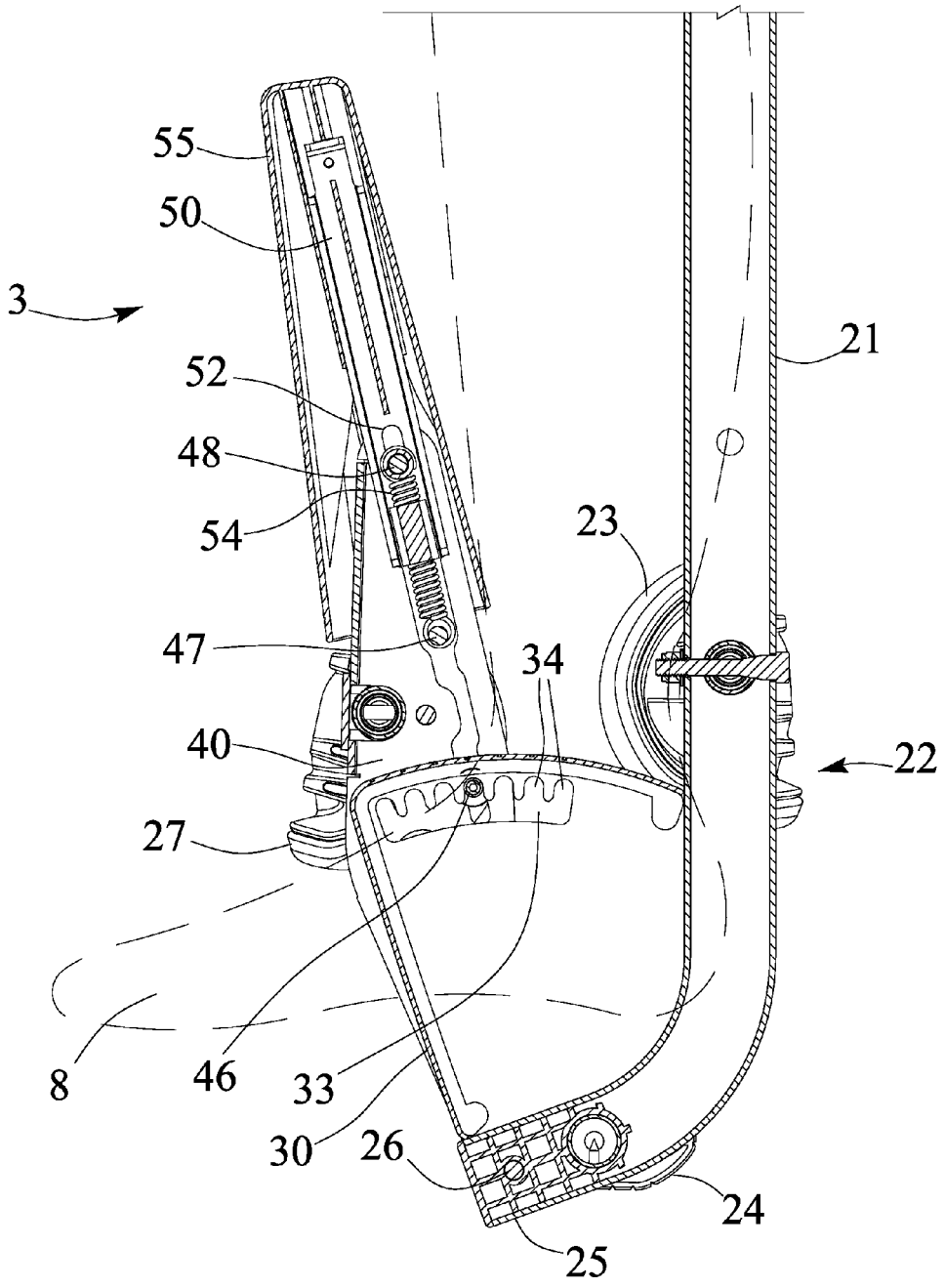

The pin 46 is slidably received or engaged in the curved channel 33 of the carrier 30 (FIGS. 5-6, 8-9) and engageable with either of the depressions 34 of the carrier 30 (FIGS. 4, 7, 10). The stem 50 further includes a slot 52 formed in the middle or intermediate portion 53 of the stem 50 for slidably receiving or engaging with the pole 48 and for further guiding and limiting the stem 50 to move up and down relative to the lever 40. One or more (such as two) spring biasing members 54 are engaged or coupled between the pole 48 and the rod 47, or coupled between the stem 50 and the lever 40 for biasing and forcing or moving the pin 46 to engage with either of the depressions 34 of the carrier 30 (FIGS. 4, 7, 10). A block or actuating member 55 is attached or mounted or secured to the upper or free end portion of the stem 50 for forcing the stem 50 to move relative to the lever 40.

Figure 5:
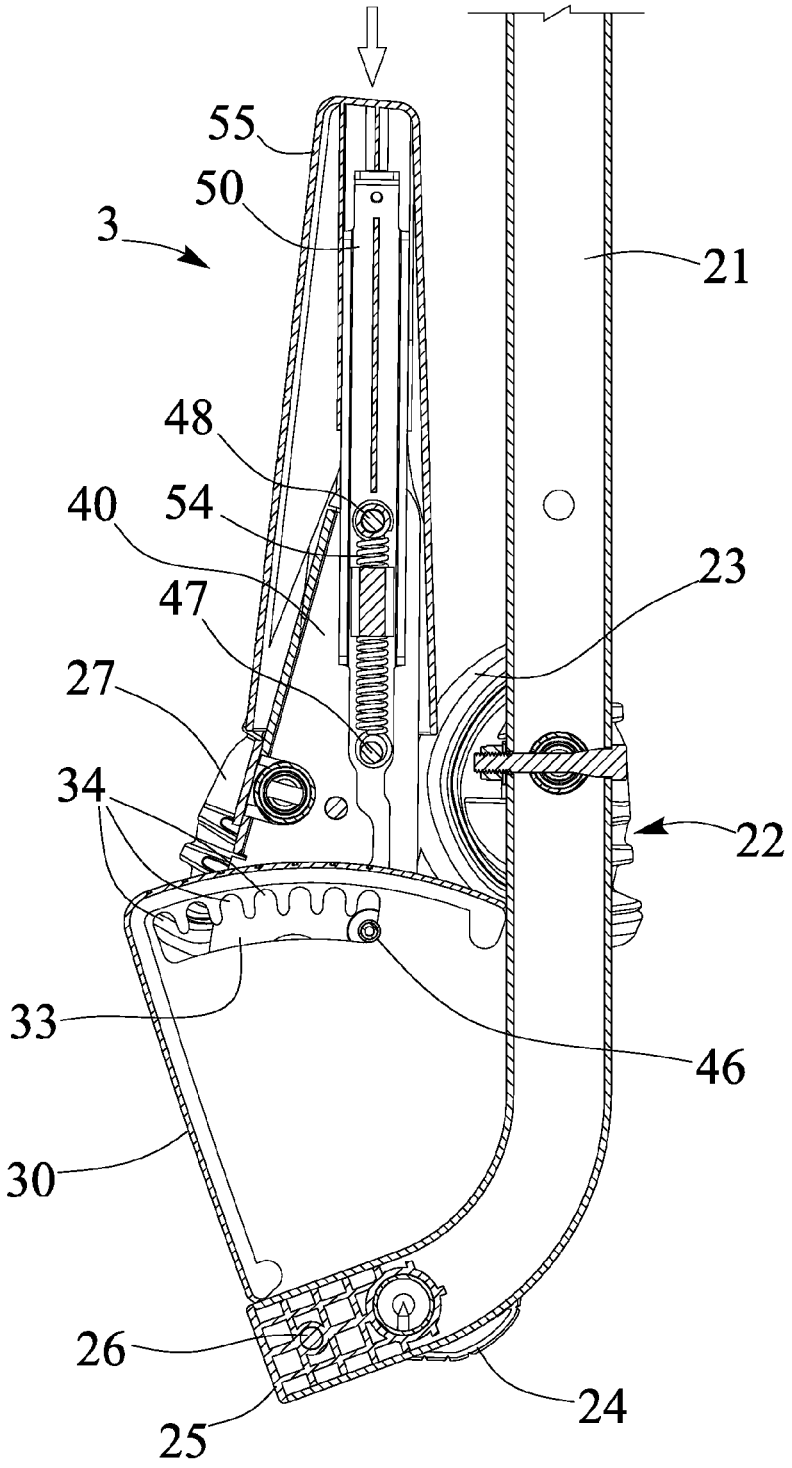
FIGS. 5, 6, 7, 8, 9, 10 are partial cross sectional views similar to FIG. 4, illustrating the operation of the ankle holder device of the tilting inversion exerciser.
Figure 6:
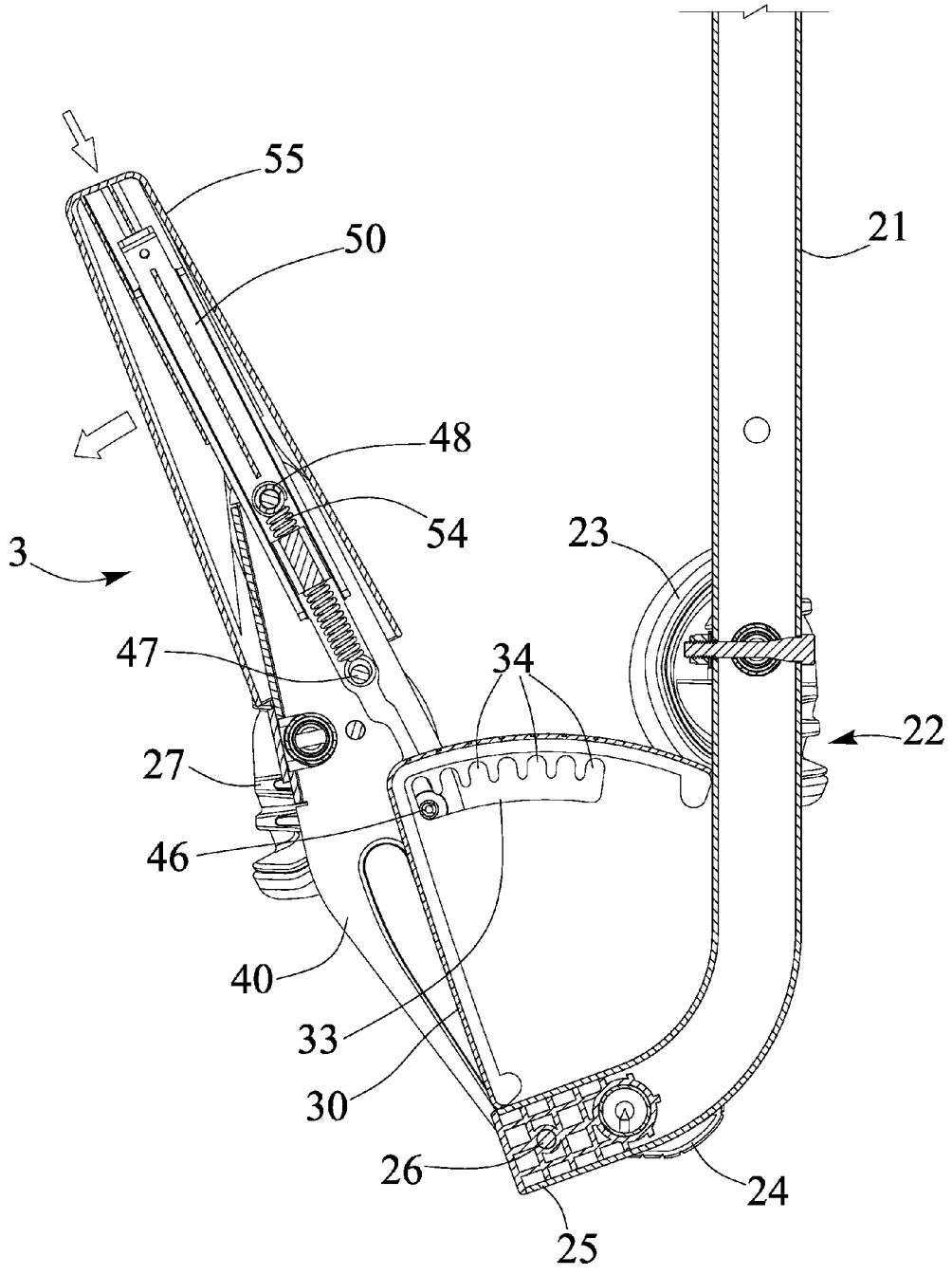
Figure 8:
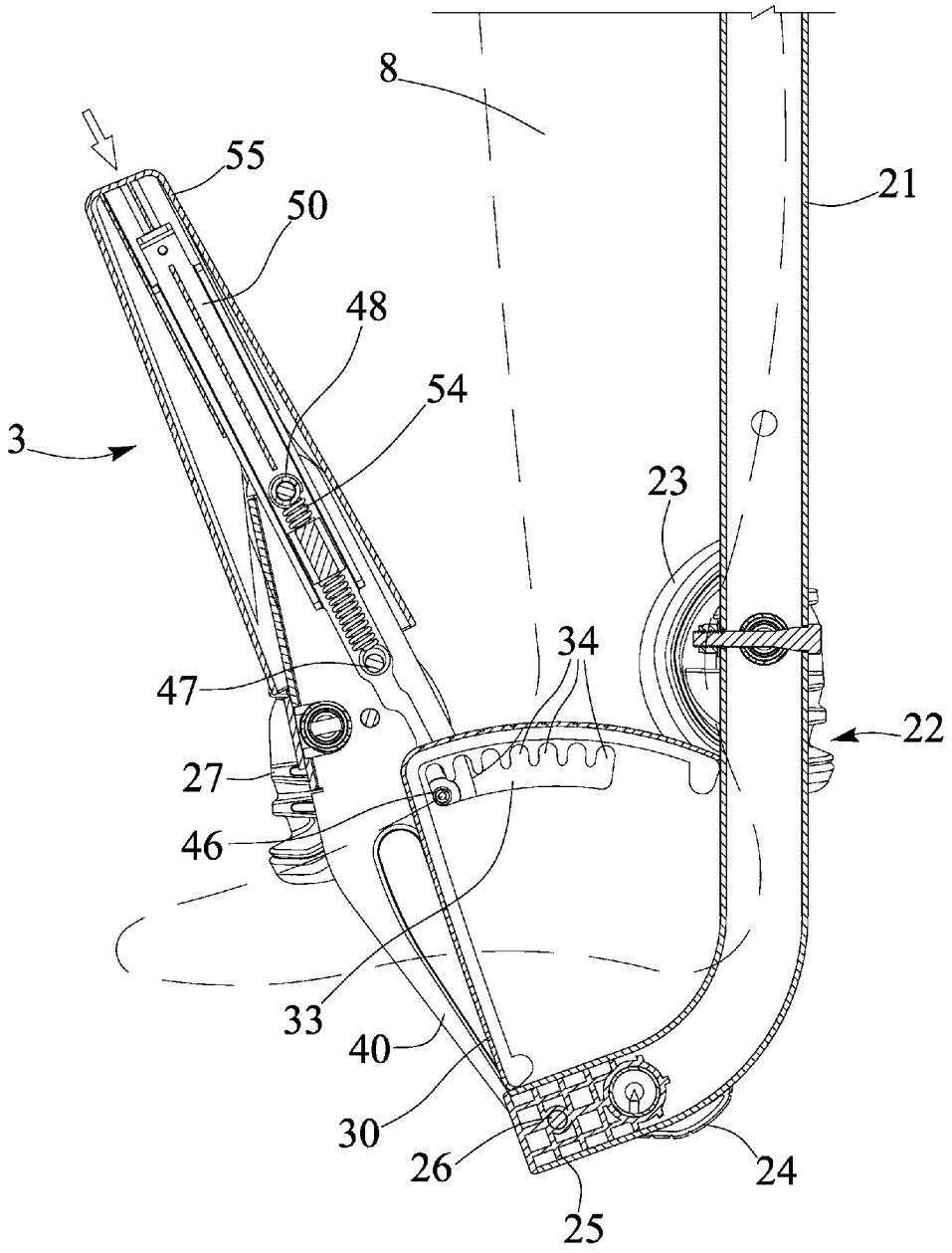
Figure 9:
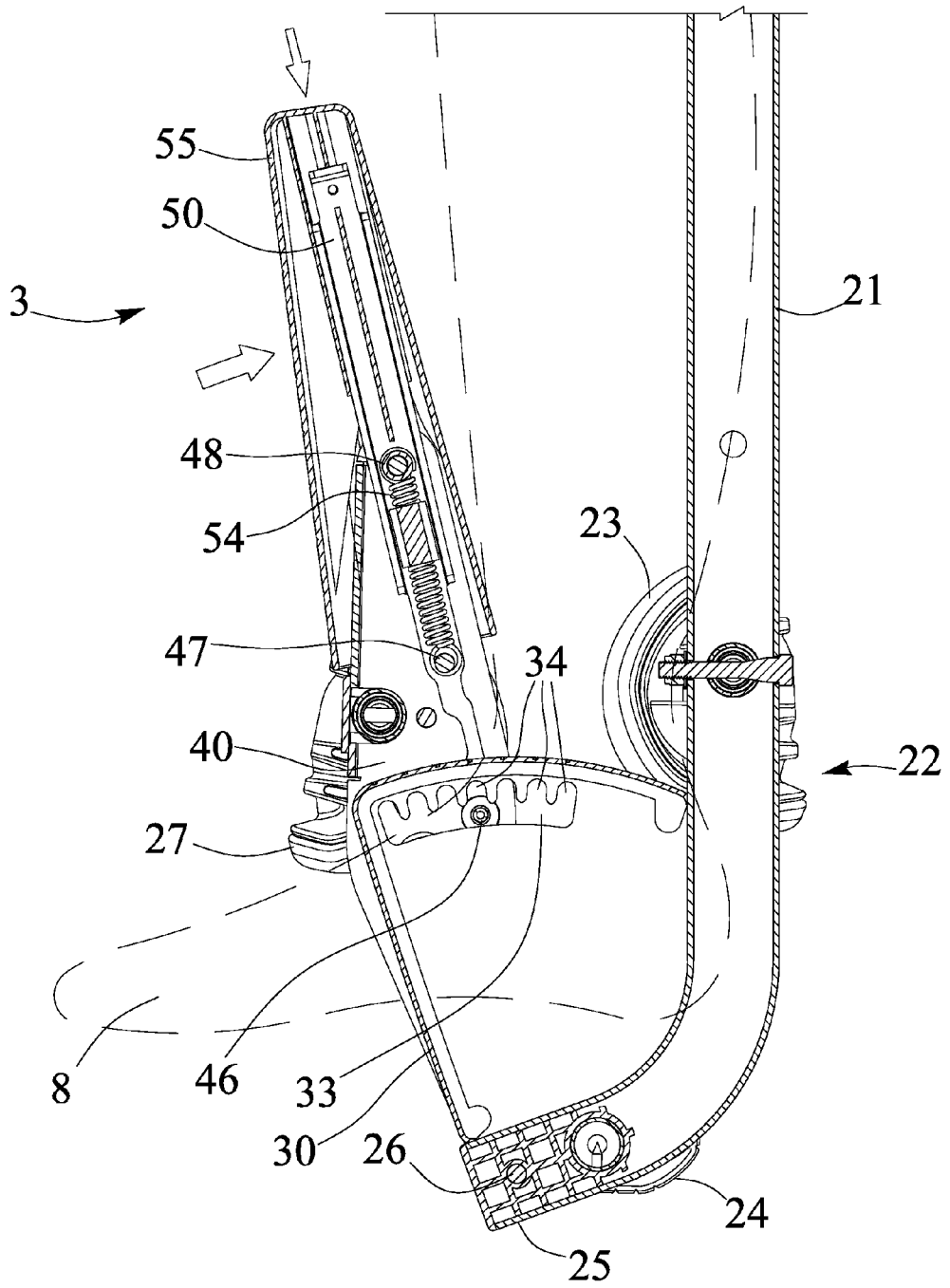

In operation, as shown in FIG. 5, when the actuating member 55 and the stem 50 are depressed or forced onto or toward the lever 40 by the user, for example, the pin 46 may be disengaged from the depressions 34 of the carrier 30 and into the curved channel 33 of the carrier 30 for allowing the pin 46 to be moved along the curved channel 33 of the carrier 30 (FIG. 6), and for allowing the lever 40 to be pivoted or rotated relative to the carrier 30 and the extension 21 of the table 20 to the required position or location, and/or for allowing the lever 40 to be pivoted or rotated away from the extension 21, and thus for allowing the foot of the user to be engaged into the space formed or defined between the fixed foot support 22 of the extension 21 and the foot anchor device 27 of the lever 40 (FIG. 8). When the actuating member 55 is released, as shown in FIG. 7, the spring biasing member 54 may bias and force or move the pin 46 to engage with either of the depressions 34 of the carrier 30.

As shown in FIG. 8, when the lever 40 and the foot anchor device 27 are pivoted or rotated or moved away from the fixed foot support 22 of the extension 21, the foot of the user may be engaged into the space that is formed or defined between the fixed foot support 22 of the extension 21 and the foot anchor device 27 of the lever 40, and the ankle portions 8 of the user may be clamped or anchored or secured or retained between the fixed foot support 22 of the extension 21 and the foot anchor device 27 of the lever 40 (FIG. 9) when the lever 40 and the foot anchor device 27 are pivoted or rotated or moved toward the fixed foot support 22 of the extension 21 and when the pin 46 is moved into the curved channel 33 of the carrier 30 again, for clamping or retaining the foot of the user to the table 20 and the extension 21, and for preventing the foot of the user from being disengaged from the table 20 and the extension 21 inadvertently. The spring biasing member 54 may bias and force or move the pin 46 to engage with either of the depressions 34 of the carrier 30 again when the actuating member 55 is released again (FIG. 10).

Figure 14:
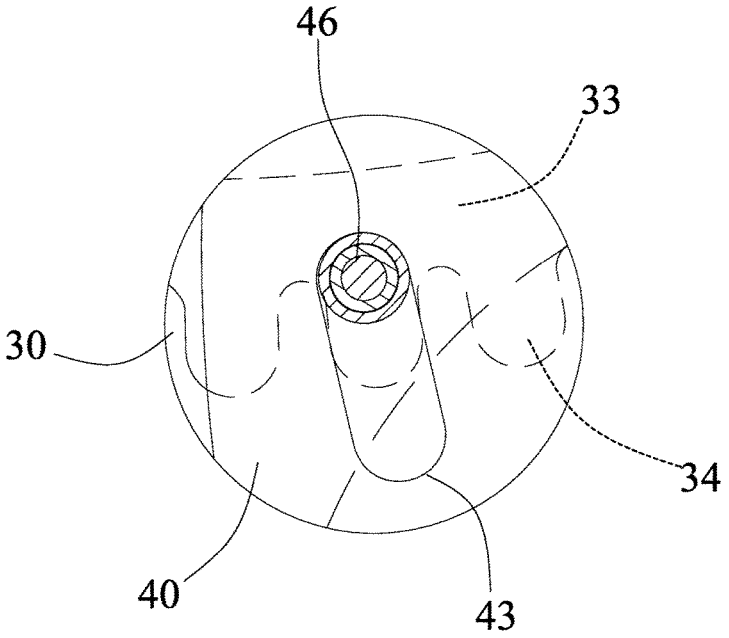
FIG. 14 is an enlarged partial cross sectional view illustrating the operation of the ankle holder device of the tilting inversion exerciser.
Figure 15:
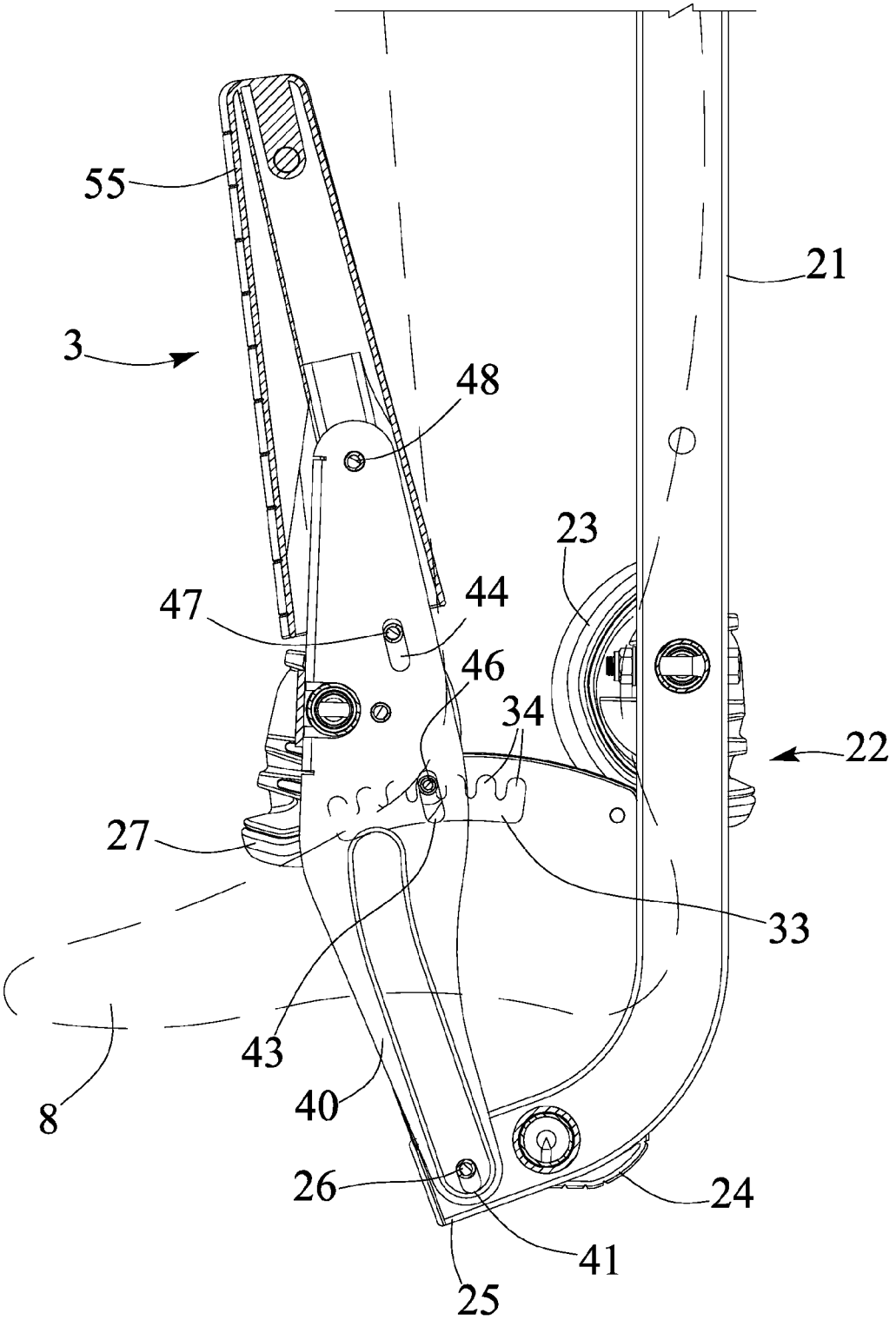
FIG. 15 is another partial cross sectional view similar to FIGS. 4-13, illustrating the operation of the ankle holder device of the tilting inversion exerciser when the tilting inversion exerciser and the ankle holder device are rotated back to the normal status or position.

As shown in FIGS. 11-14, when the table 20 of the tilting inversion exerciser and the ankle holder device 3 are inverted to an up-side-down status or position where the extension 21 is located above the table 20, the lever 40 and the foot anchor device 27 which is engaged with the foot of the user may be forced to move downwardly relative to the extension 21 and the spindle 26 and the pin 46 and the rod 47 (FIG. 13), i.e., the lever 40 is movable downwardly relative to the extension 21 and the spindle 26 and the pin 46 with the sliding engagement between the pin 46 and the oblong hole 41 of the lever 40, and the spindle 26 may be engaged with the upper portion of the oblong hole 41 of the lever 40, and the rod 47 may be engaged with the upper portion of the passage 44 of the lever 40, and the pin 46 may be engaged with the upper portion of the groove 43 of the lever 40 (FIG. 14). At this moment, the lever 40 may be engaged with the pin 46 for solidly and stably anchoring or retaining or positioning the pin 46 in the selected depression 34 of the carrier 30 for preventing the pin 46 from being disengaged from the selected depression 34 of the carrier 30 and for preventing the pin 46 from being engaged into the curved channel 33 of the carrier 30, and thus for preventing the lever 40 from being pivoted or rotated relative to the carrier 30 and the extension 21 of the table 20.

Accordingly, the tilting inversion exerciser in accordance with the present invention includes a rotating ankle holder or foot retaining device for detachably securing the ankle portions or the feet of the user to the foot retaining device of the tilting inversion exerciser and for giving some security to the user while conducting the inversion exercises and for preventing the feet of the user from being disengaged from the foot retaining device inadvertently, and thus for allowing the user to safely conduct or operate the inversion exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting inversion exerciser comprising:

a supporting stand, a table rotatably supported on said supporting stand with a pivot axle, and including an extension extended from said table, and including a foot support attached to said extension, and including a carrier attached to said extension, the carrier including a curved channel formed therein, and the carrier including a plurality of depressions formed therein and communicating with the curved channel of the carrier, a spindle attached to the extension, and a foot retaining device including:

a lever including an oblong hole formed in a first end portion of the lever for slidably engaging with the spindle and for allowing the lever to be pivoted relative to the carrier and the extension, a foot anchor device attached to the lever and movable toward and away from the foot support of the extension when the lever is pivoted relative to the carrier and the extension, a stem slidably attached to the lever, the stem including a first end portion, a pin attached to the first end portion of the stem and slidably engaged in the curved channel of the carrier, a spring biasing member coupled between the stem and the lever for biasing the pin to engage with any of the depressions of the carrier, wherein the stem includes a slot formed therein, and said lever includes a pole attached to a second end portion of the lever and slidably engaged in the slot of the stem engaging with the pole for guiding the stem to move relative to the lever, wherein said stem includes a rod attached to said stem, and said spring biasing member is coupled between the rod and the pole, wherein said lever includes a groove formed therein for slidably engaging with the rod, and when the extension of the table is inverted to an up-side-down position where the extension is located above the table, the lever is movable downwardly relative to the extension and the spindle and the pin with a sliding engagement between the pin and the oblong hole of the lever, and the lever is engageable with the pin for retaining the pin in any of the depressions of the carrier, and for preventing the pin from being disengaged from the depressions of the carrier.

2. The tilting inversion exerciser as claimed in claim 1, wherein said foot retaining device includes an actuating member attached to the stem for forcing the stem to move relative to the lever.

* * * * *